US009295307B2

(12) United States Patent
Tominaga et al.

(10) Patent No.: US 9,295,307 B2
(45) Date of Patent: Mar. 29, 2016

(54) SLIDE FASTENER AND METHOD FOR MANUFACTURING THE SAME

(75) Inventors: Yutaka Tominaga, Toyama (JP); Koichiro Yamada, Tokyo (JP); Yasushi Sato, Tokyo (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/816,236

(22) PCT Filed: Aug. 11, 2010

(86) PCT No.: PCT/JP2010/063667
§ 371 (c)(1),
(2), (4) Date: Feb. 10, 2013

(87) PCT Pub. No.: WO2012/020492
PCT Pub. Date: Feb. 16, 2012

(65) Prior Publication Data

US 2013/0232738 A1 Sep. 12, 2013

(51) Int. Cl.
*A44B 1/04* (2006.01)
*A44B 19/08* (2006.01)
(Continued)

(52) U.S. Cl.
CPC ..... *A44B 19/08* (2013.01); *A44B 19/32* (2013.01); *A44B 19/62* (2013.01); *Y10T 24/2596* (2015.01); *Y10T 29/49782* (2015.01)

(58) Field of Classification Search
CPC ..... A44B 19/34; A44B 19/32; A44B 19/38; Y10T 24/25; Y10T 24/2591; Y10T 24/2595; Y10T 24/2596
USPC ..... 24/435, 381, 392, 393, 397, 398, 403, 24/405, 408; 264/154, 273, 400
See application file for complete search history.

(56) References Cited

U.S. PATENT DOCUMENTS 2,701,222 A * 2/1955 Hetzel et al. ..... 156/66
4,651,389 A * 3/1987 Yoshida et al. ..... 24/433
(Continued)

FOREIGN PATENT DOCUMENTS

JP 154113/1984 10/1984
JP 20815/1985 2/1985
(Continued)

OTHER PUBLICATIONS

International Preliminary Report on Patentability, PCT Application No. PCT/JP2010/063667, mailed Mar. 12, 2013.
(Continued)

*Primary Examiner* — Robert J Sandy
*Assistant Examiner* — Matthew Sullivan
(74) *Attorney, Agent, or Firm* — Kilpatrick Townsend & Stockton LLP

(57) ABSTRACT

There is provided a slide fastener including a pair of fastener stringers in which a plurality of fastener elements, are attached to opposing one-side edges of a pair of fastener tapes each of which is formed by coating a woven and tape-shaped core material with a coating material to form respective fastener element rows, and a slider slidably attached to the fastener element rows to engage and disengage the fastener elements. The tape-shaped core material is formed with a plurality of holes penetrating in a front back direction thereof the holes disposed at positions outer than the fastener elements in a width direction and arranged along a longitudinal direction of the fastener tapes. An edge of the each of the holes is molten, and the coating material is formed so as to cove the plurality of holes.

6 Claims, 7 Drawing Sheets

(51) Int. Cl.
*A44B 19/32* (2006.01)
*A44B 19/62* (2006.01)

(56) References Cited

U.S. PATENT DOCUMENTS

| | | | | |
|---|---|---|---|---|
| 4,765,038 | A | 8/1988 | Kasai | |
| 5,040,274 | A * | 8/1991 | Keech | 24/381 |
| 5,985,438 | A * | 11/1999 | Watanabe | 428/343 |
| 8,083,040 | B2 * | 12/2011 | Chiang | 190/119 |
| 8,667,652 | B2 * | 3/2014 | Thomas et al. | 24/389 |
| 2005/0217086 | A1 | 10/2005 | Kusayama et al. | |
| 2007/0137006 | A1 * | 6/2007 | Mikuma et al. | 24/403 |
| 2007/0169320 | A1 | 7/2007 | Kusayama et al. | |
| 2007/0226966 | A1 | 10/2007 | Tominaga | |
| 2009/0144948 | A1 * | 6/2009 | Jeon | 24/403 |
| 2010/0059594 | A1 * | 3/2010 | van den Berg | 235/488 |

FOREIGN PATENT DOCUMENTS

| | | | |
|---|---|---|---|
| JP | 107227/1985 | | 7/1985 |
| JP | 2005-237577 | A | 9/2005 |
| JP | 2007-167220 | A | 7/2007 |
| JP | 2007-267935 | A | 10/2007 |
| JP | 2009-090108 | A | 4/2009 |

OTHER PUBLICATIONS

International Search Report, PCT Application No. PCT/JP2010/063667, mailed Nov. 16, 2010.

* cited by examiner

SLIDE FASTENER AND METHOD FOR MANUFACTURING THE SAME

This application is a national stage application of PCT/JP2010/063667 which is incorporated herein by reference.

TECHNICAL FIELD

The present invention relates to a slide fastener and a method for manufacturing the same, and more particularly, to a slide fastener having water-tightness and gas-tightness, and a method for manufacturing the same.

BACKGROUND ART

A slide fastener includes fastener stringers formed by attaching fastener elements to opposite edge portions of a pair of fastener tapes in a row shape. Bottom end stops are attached to lower end portions of the fastener element rows of the fastener stringers (otherwise, a separable end stop having an insert pin is attached to one fastener stringer, while a separable end stop having a box pin is attached to the other fastener stringer), while top end stops are attached to upper end portions. A slider for engaging or disengaging the fastener elements is slidably inserted between the top end stop and the bottom end stop (otherwise, the separable end stops).

The water-tightness and the gas-tightness are required for such a slide fastener depending on its use purpose. In such a slide fastener, a pair of fastener tapes in which front and back of a woven tape-shaped core material are coated by thermoplastic elastomer which is a coating material, and fastener element rows provided on side edges of the pair of fastener tapes form fastener stringers. As the fastener elements are engaged with each other by the slider, the edges of the fastener tapes come in close contact with each other to obtain the water-tightness and the gas-tightness (e.g., see Patent Document 1).

In the fastener tape having the water-tightness and the gas-tightness, if coupling between the tape-shaped core material and the covering material is not sufficient, delamination occurs between the tape-shaped core material and the covering material at use, and thus the covering material may be lifted up from the tape-shaped core material. In the slide fastener disclosed in Patent Document 1, the tape-shaped core material is made of a spun yarn of cut fibers, and the tape-shaped core material and the coating material are engaged with each other by extrusion or lamination. In this instance, the coating material is coupled to the irregular rough surface of the yarn due to the cut fibers, thereby making the coupling strong and thus enhancing the resistance to the delamination. In addition, in the slide fastener disclosed in Patent Document 1, as an adhesive is used between the tape-shaped core material and the coating material, the resistance to the delamination between the tape-shaped core material and the coating material is further enhanced.

PRIOR ART DOCUMENT

Patent Document

Patent Document 1: Japanese Patent Application Publication No. 2009-090108A

SUMMARY OF INVENTION

Problems to be Solved by Invention

In the slide fastener disclosed in Patent Document 1, it is considered that the coating material is coupled to the irregular rough surface of the yarn due to the cut fibers. However, since the coating material is flexible elastomer, it is hard to anticipate enhancement in strength. Also, since the surface is irregular, irregularity may happen in the resistance to the delamination.

Furthermore, in the case where the adhesive is used between the tape-shaped core material and the coating material, it is difficult to apply the adhesive evenly. Due to biasing of the adhesive or the like when the coating material is formed on the tape-shaped core material, the irregularity may happen in the resistance to the delamination. Also, there is a problem in that as the adhesive is hardened, the fastener tape become hard.

The present invention has been made in view of the above-described problem, and an object of the present invention is to provide a slide fastener in which a tape-shaped core material and a coating material of the fastener can be firmly engaged with each other, and a method for manufacturing the same.

Means for Solving Problems

The above object of the present invention can be achieved by the following configuration.

(1) A slide fastener including: a pair of fastener stringer in which a plurality of fastener elements are attached to opposing one-side edges of a pair of fastener tapes each of which is formed by coating a woven and tape-shaped core material with a coating material, to form respective fastener element rows; and a slider slidably attached to the fastener element rows to engage and disengage the fastener elements, wherein the tape-shaped core material is formed with a plurality of holes penetrating in a front-back direction thereof, at positions outer than the fastener elements in a width direction and arranged along a longitudinal direction of the fastener tapes, and wherein an edge of each of the holes is molten, and the coating material is formed so as to cover the plurality of holes.

(2) The slide fastener according to the configuration of the above (1), wherein a total area of the plurality of holes formed in the tape-shaped core material is smaller than an area of a portion of the tape-shaped core material, the portion outer than the fastener elements in the width direction and other than the holes.

(3) The slide fastener according to the configuration of the above (1) or (2), wherein when a distance between an end portion of each of the fastener elements and an other-side edge of the fastener tape, opposite to the one-side edge is set to L, at least one of the plurality of holes is positioned in a region of L/4 from the end portion.

(4) A method for manufacturing the slide fastener according to the configuration of the above (1), wherein the fastener stringer is manufactured by: opening a plurality of holes which penetrate front and back of a woven and tape-shaped core material, along a longitudinal direction of the tape-shaped core material with use of heat to melt an edge of each of the holes; forming a coating material on the tape-shaped core material; forming a plurality of fixation holes which penetrate the tape-shaped core material and the coating material, at an one-side edge of the fastener tape; and attaching fastener elements to the one-side edge with injection molding.

(5) The method for manufacturing the slide fastener according to the configuration of the above (4), wherein the plurality of holes are opened by heat from a laser machining device.

Advantageous Effects of Invention

According to the slide fastener of the present invention, the tape-shaped core material is formed with a plurality of holes penetrating in the front-back direction thereof, the holes disposed at positions outer than the fastener elements in a width direction and arranged along a longitudinal direction of the fastener tapes. An edge of each of the holes is molten, and the coating material is formed so as to cover the plurality of holes. Accordingly, strength of the woven and tape-shaped core material can be secured, and the fastener tape formed by coating the tape-shaped core material with the coating material can firmly engage the tape-shaped core material and the coating material.

Furthermore, according to the method for manufacturing the slide fastener of the present invention, the fastener stringer is manufactured by opening a plurality of holes which penetrate front back of a woven and tape-shaped material, along a longitudinal direction of the tape-shaped core material with use of heat to melt an edge of each of the holes; forming a coating material on the tape-shaped core material; forming a plurality of fixation holes which penetrate the tape-shaped core material and the coating material, at an one-side edge of the fastener tape; and attaching fastener elements to the one-side edge with injection molding. Accordingly, while the strength of the woven and tape-shaped core material is secured, it is possible to manufacture the slide fastener in which the tape-shaped core material and the coating material of the fastener tape are firmly engaged with each other.

EMBODIMENTS OF INVENTION

One embodiment of a slide fastener according to the present invention will now be described in detail with reference to the accompanying drawings. In the following description of the embodiment, an up-down direction indicates a longitudinal direction of fastener tapes in the slide fastener. A sliding direction of the slider when the slide fastener is closed is referred to as upward (upper side on a paper surface of FIG. 1), and a sliding direction of the slider when the slide fastener is opened is referred to as downward (lower side on the paper surface of FIG. 1). In addition, a left and right direction indicates a tape width direction of the fastener tapes, and also is a direction horizontal with respect to the fastener tape surface and perpendicular to the longitudinal direction. Herein, a left side with respect to the paper surface of FIG. 1 when the slide fastener is seen from the front side (side illustrated in FIG. 1) is referred to as a left direction, and a right side is referred to as a right direction.

Figure 1:
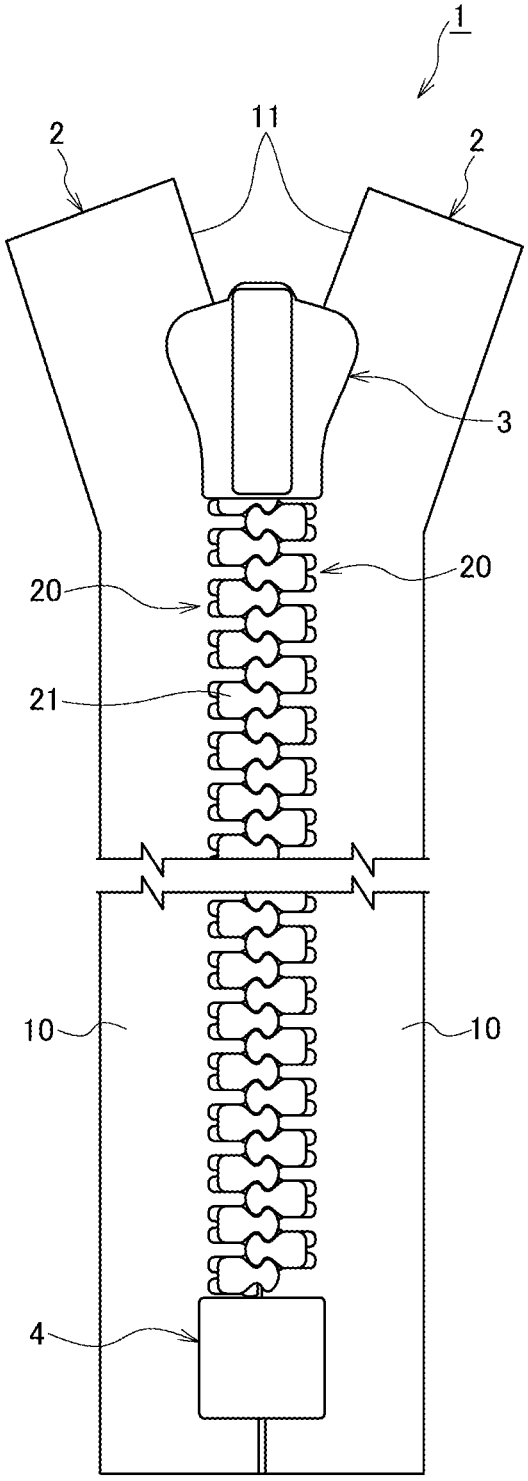
FIG. 1 is a plan view of a slide fastener according to one embodiment of the present invention.

The thickness direction indicates a tape front-back direction perpendicular to the tape surface of the fastener tape. A front side may be referred to as a near side with respect to the paper surface of FIG. 1, and a back side may be referred to as a far side with respect to the paper surface of FIG. 1. In FIG. 1, a side on which a pull tap is disposed is referred to as a front side, and a side opposite to the front side is referred to as a back side.

As illustrated in FIG. 1, a slide fastener 1 of this embodiment includes a pair of fastener stringer 2 in which a plurality of fastener elements 21 are attached to opposing one-side edges 11 of a pair left and right fastener tapes 10 in a row shape in a longitudinal direction of the fastener tapes 10, to form a pair of left and right fastener element rows 20, and a slider 3 slidably attached to the fastener element rows 20 to engage and disengage the fastener elements 21. Further, a bottom end stop 4 is attached to a lower end of the fastener element rows 20, and a top end stop (not illustrated) is attached to an upper end of the fastener element rows 20, so that the slider 3 is not escaped from the lower end and the upper end of the fastener element rows 20.

The plurality of fastener elements 21 is formed on the one-side edges 11 with injection molding using synthetic resin, for example, polyamide, polyacetal, polypropylene, or polybutylene terephthalate. The plurality of fastener elements 21 are attached at a pitch P2 which is a regular interval in the longitudinal direction of the fastener tape 10. The pitch P2 is an interval along the longitudinal direction of the fastener tape 10 of the fastener elements 21, and the fastener elements 21 of the left and right fastener stringers 2 are attached at the same pitch P2.

The pair of left and right fastener tapes are manufactured by adhering and coating the front and back surfaces of a tape-shaped core material 14, which is woven by, for example, twill pattern weave, which is referred to as herringbone weave, using a warp yarn 12 and a weft yarn 13 (see FIG. 6B), and left and right outsides of the tape-shaped core material 14 with a coating material 15 made of, for example, natural or synthetic rubber material, or a thermoplastic elastomer material (e.g., polyester elastomer or polyurethane elastomer) through extrusion molding. Each element molding region A (see FIG. 6A), in which the fastener elements 21 are attached along the one-side edges 11 of the fastener tape 10, is formed with fixation holes 16 having a size which is sufficient for passage of raw resin which is a molten state of the fastener elements 21, at the pitch P2 which is the attaching interval of the fastener elements 21.

The warp yarn 12 and the weft yarn 13 use multi-filament yarn made of synthetic resin such as polyamide or polyethylene terephthalate. The multi-filament yarn is one yarn made by twisting plural filament yarns. The fixation holes 16 are formed so as to penetrate the front and back of the coating material 15 and the tape-shaped core material 14. The fixation holes 16 are holes larger than a plurality of holes 17 formed in the tape-shaped core material 14, and the fixation holes 16 and the plurality of holes 17 are formed at intervals in the width direction of the fastener tape 10. In this instance, the coating is to cover the front and back surfaces of at least the tape-shaped core material 14, and the coating material 15 may be formed only on the respective front and back surfaces thereof.

Figure 2:
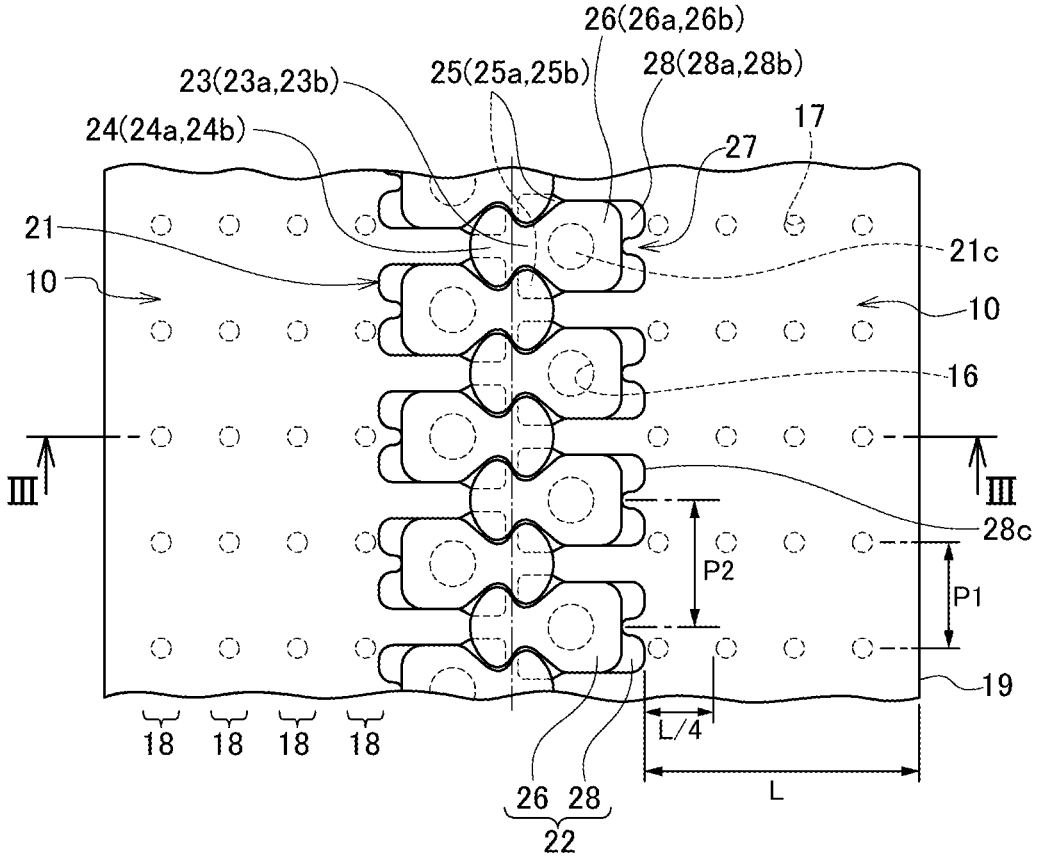
FIG. 2 is a plan view illustrating a coupling portion of the slide fastener in FIG. 1.

As illustrated in FIG. 2, the fastener element 21 includes a base portion 22 attached to the one-side edge 11 of the fastener tape 10, a head portion 23 extending from the base portion 22 to the fastener element 21 of the opposite fastener tape 10, an engagement head portion 24 extending from the head portion 23 in a direction opposite to the base portion 22 and protruding in a convex shape in the longitudinal direction, and a pair of shoulder portions 25 widened from the head portion 23 to the base portion 22, and extending in both side of the head portion 23 in the longitudinal direction of the fastener tape. The base portion 22 has a thick body portion 26 and leg portions 28 branched via a thigh portion 27. The leg portions 28 extend from the body portion 26 in a direction opposite to the head portion 23 along the width direction of the fastener tape 10. In this instance, the base portion 22 may not have the leg portions 28.

Figure 3:
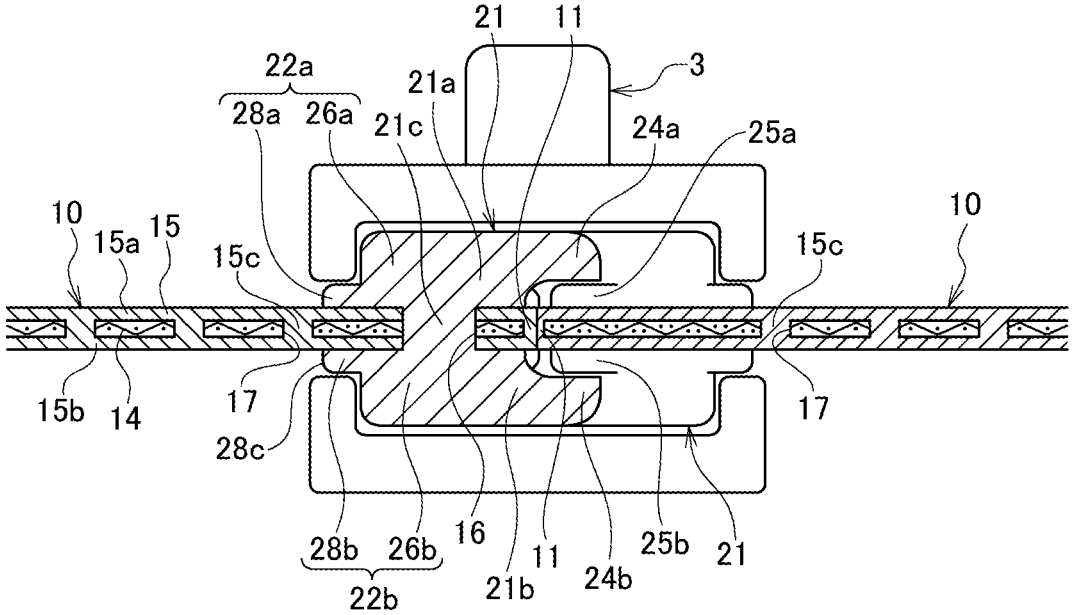
FIG. 3 is a cross-sectional view taken along the line III-III in FIG. 2.

As illustrated in FIGS. 2 and 3, the fastener element 21 having the above configuration consists of half portions 21*a* and 21*b* which are integrally coupled to each other via a coupling portion 21*c* which is formed on the fixation hole 16, with the one-side edge 11 of the fastener tape being interposed therebetween, and which are integrally molded on the front and back surfaces of the fastener tape 10. The front side of the fattener tape 10 is referred to as a front-side half portion 21*a*, and the back side of the fattener tape 10 is referred to as a back-side half portion 21*b*. The respective half portions 22*a*, 22*b*; 23*a*, 23*b*; 24*a*, 24*b*; 25*a*, 25*b*, 26*a*, 26*b*; 28*a*, 28*b* of the base portion 22, the head portion 23, the engagement head portion 24, the shoulder portion 25, the head portion 26, and the leg portion 28 is respectively integrally molded on the front and back surfaces of the fastener tape 10 in a symmetrical shape, with the tape 10 being interposed therebetween. Also, the half portions 25*a* and 25*b* of the shoulder portion, the half portions 26*a* and 26*b* of the body portion, and the half portions 28*a* and 28*b* of the leg portions are integrally bonded on both the front and back surfaces of the fastener tape 10. The fixation hole 16 is covered by the fastener element 21.

If the opposing fastener elements 21 of the left and right fastener stringers 2 are engaged with each other, inner surfaces of the half portions 24*a* and 24*b* of the engagement head portion 24 of the fastener element 21 respectively abut against the half portions 25*a* and 25*b* of the should portions 25 of the fastener element 21 which is engaged with the fastener element 21 in the longitudinal direction of the fastener tape 10. In this instance, as illustrated in FIG. 3, the half portions 25*a* and 25*b* of the shoulder portion 25 of the right fastener element 21 are positioned between the half portions 24*a* and 24*b* of the engagement head portion of the left fastener element 21 to abut against the half portions.

As illustrated in FIGS. 2 and 3, the tape-shaped core material 14 of the fastener tape 10 is formed with the plurality of holes 17 of about 0.7 mm in diameter, penetrating in the front-back direction of the tape-shaped core material 14, the holes 17 disposed at the positions outer than the fastener element 21 in the width direction (a direction away from the opposite fastener stringer 2), more particularly, at the end opposite to the opposite fastener element 21 in the width direction of the fastener element 21 (outer end in the width direction), for example, at the positions outer than the end 28*c* of the leg portion 28 in the width direction (a direction away from the opposite fastener stringer 2). As a result, when the front and back surfaces of the tape-shaped core material 14 are coated with the coating material 15 with the extrusion molding, the elastomer material configuring the coating material 15 passes through the plurality of holes 17 of the tape-shaped core material 14, and then is integrally coupled to coating layers 15*a* and 15*b* of the front and back by coupling portions 15*c*.

In this embodiment, the plurality of holes 17 are arranged side by side at the same interval of the predetermined pitch P1 along the longitudinal direction of the fastener tapes 10 to form plural linear hole rows 18, and the hole rows 18 are arranged in plural rows (four rows in this embodiment) side by side in the width direction of the fastener tape 10.

The predetermined pitch P1 between the holes 17 which are adjacent to each other in the longitudinal direction of the fastener tapes 10 is set to be equal to or less than the pitch P2 between the adjacent fastener elements 21 arranged at the same interval. Herein, the pitch P2 is an interval between the fastener elements 21 arranged at the same interval, for example, an interval between the adjacent fastener elements 21.

When a distance between an end portion 28*c* of the base portion 22 of each the fastener elements 21 and the other-side edge 19 of the fastener tape 10 opposite to the one-side edge 11 in the width direction is set to L, each hole 17 of the hole row 18 positioned at the innermost side (at the side of the one-side edge 11) of the fastener tape 10 in the width direction, among the plurality of hole rows 18, is positioned in a region of L/4 from the end portion 28*c* of the base portion 22 in the width direction. The region of L/4 from the end portion 28*c* of the base portion 22 in the width direction is a region opposite to the slider 3 when the slider 3 is slid. As the plurality of holes 17 are installed in the region of L/4 in the width direction, it is possible to prevent the coating material 15 from peeling off from the tape-shaped core 14 due to the sliding of the slider 3.

Figure 6A:
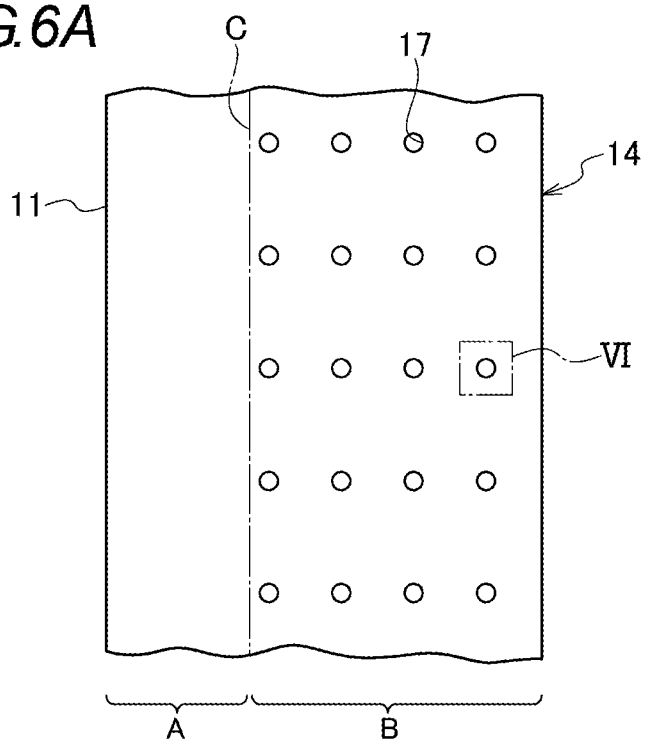
FIG. 6A is a plan view illustrating the tape-shaped core material.
Figure 6B:
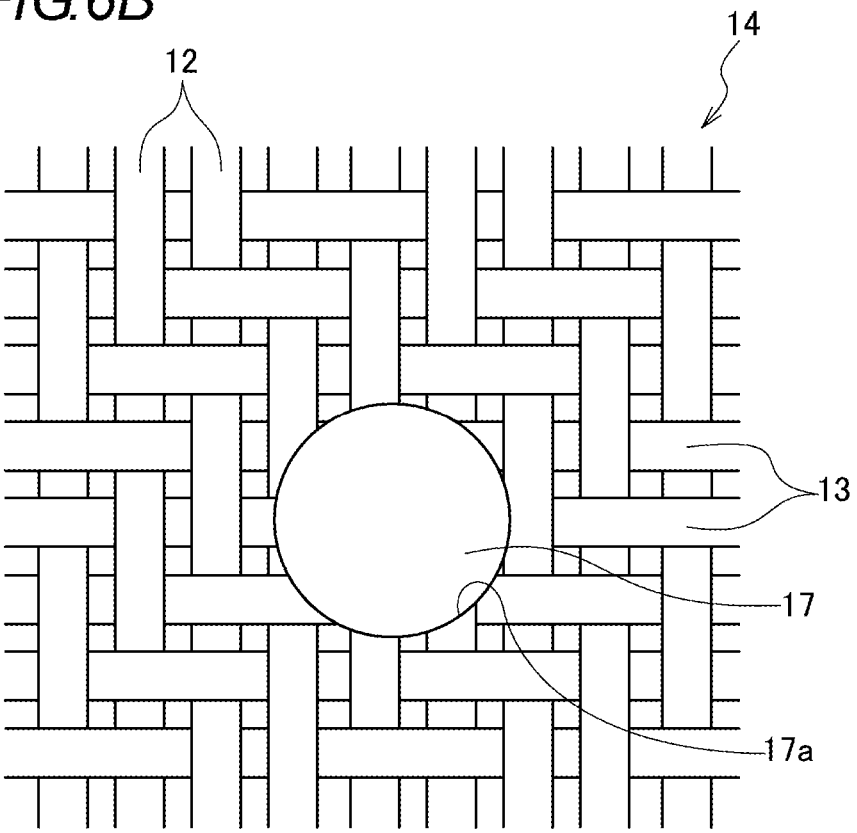
FIG. 6B is an enlarged view of a major portion of the portion VI in FIG. 6A.

In addition, as illustrated in FIG. 6B, the respective holes 17 is punched by a laser machining device, and an edge 17*a* thereof is molten. The hole 17 may be punched by using heated air or piercing a heated needle member, instead of the laser machining device. In the molten state, there is shown a place in which each filament of the multi-filament yarn configuring the warp yarn 12 and the weft yarn 13 which is adhered to each other. That is, the end portion of the respective filaments is integrally bonded on the edge 17*a*. In addition, if the molten place is a portion in which the warp yarn 12 and the weft yarn 13 are intersected, the intersected portion is adhered.

As illustrated in FIG. 6A, the tape-shaped core material 14 of this embodiment is formed to have a thickness thicker than that of an element non-shaping region B, since the amount of the warp yarn 12 in the element shaping region A of the fastener tape 10 is increased that the remaining element non-shaping region B. In this instance, as the warp yarn 12 of the element shaping region A which is thicker than the warp yarn 12 of the element non-shaping region B is used, the element shaping region A may be formed to have a thickness thicker than that of the element non-shaping region B. A boundary C between element shaping region A and the element non-shaping region B approximately coincides with a position where the end portion 28*c* of the base portion 22 of the fastener element 21 is positioned in the width direction. Accordingly, the plurality of holes 17 are disposed in the element non-shaping region B.

In this instance, the plurality of holes 17 may be arbitrarily disposed if the total area of the plurality of holes 17 is smaller than an area of the portion of the tape-shaped core material 14, the portion outer than the leg portion 28 in the width direction and other than the holes 17 of the tape-shaped core material 14. For example, although the hole rows 18 are disposed in plural rows at the equal interval in the width direction, the hole rows 18 may be disposed at any interval. Also, the hole rows 18 may be disposed in a zigzag pattern, for example, by differently positioning the respective holes 17 of the hole rows 18 positioned inside the fastener tape 10 in the width direction, and the respective holes 17 of the hole rows 18 adjacent to this hole rows 18.

Figure 4:
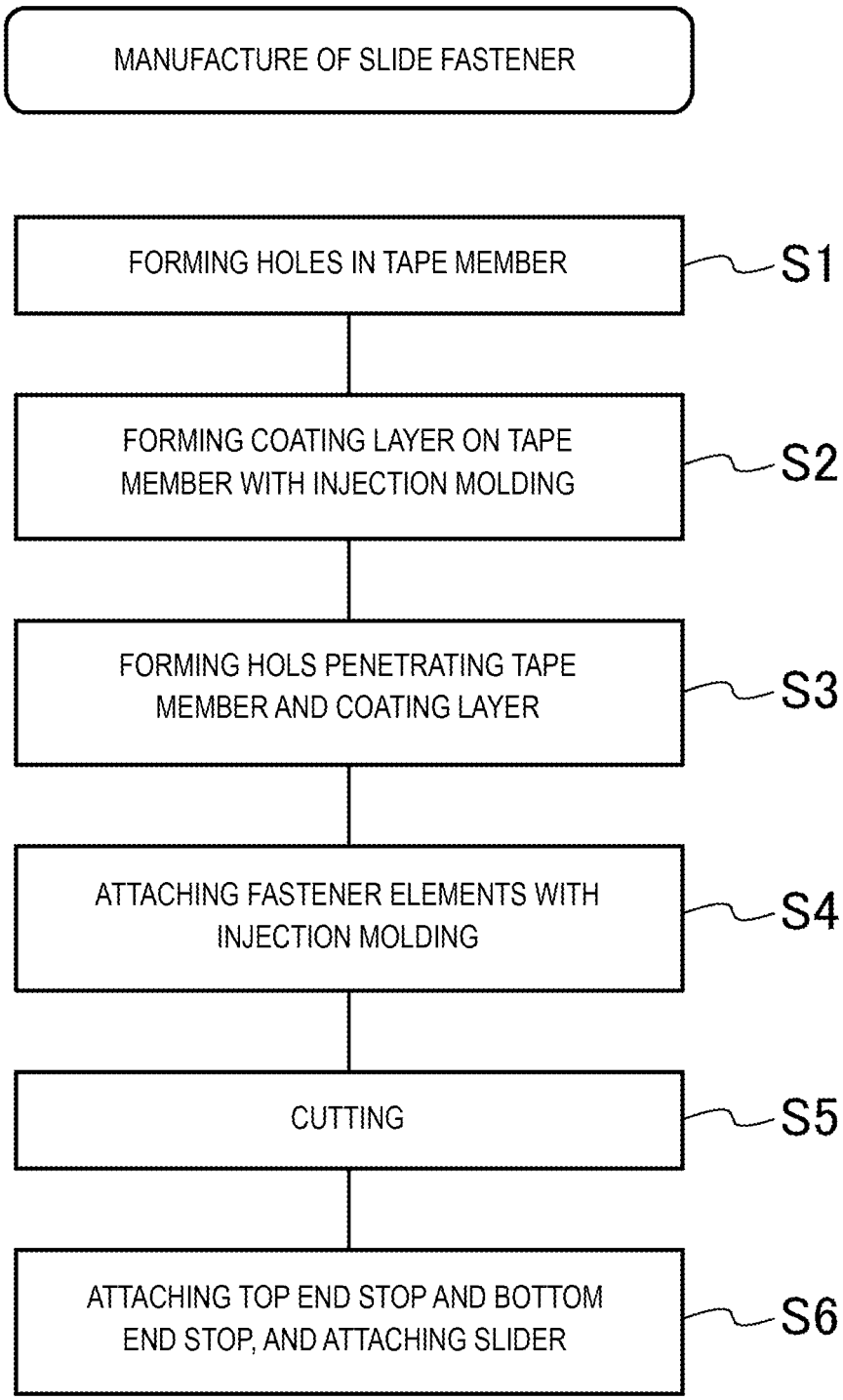
FIG. 4 is a flowchart illustrating a process of manufacturing a fastener stringer.

Next, a process of manufacturing the slide fastener 1 will now be described with reference to FIG. 4.

Figure 5A:
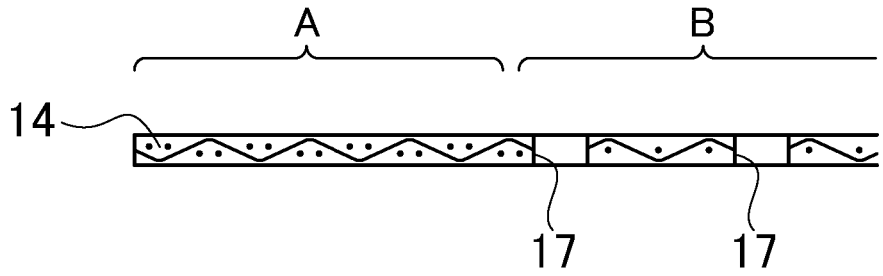
FIG. 5A is a cross-sectional view illustrating a tape-shaped core material.
Figure 5B:
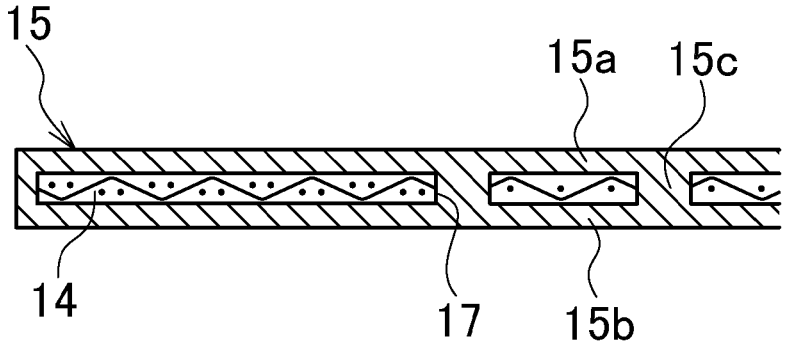
FIG. 5B is a cross-sectional view illustrating a fastener tape with the tape-shaped core material coated by a coating material.
Figure 5C:
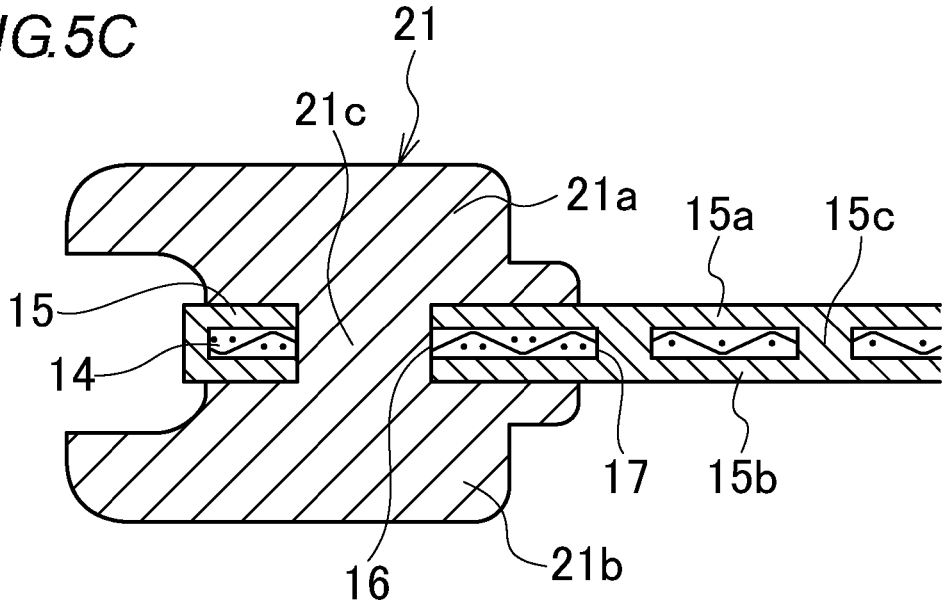
FIG. 5C is a cross-sectional view illustrating the fastener stringer with a fastener element fixed to the fastener tape.

First, as illustrated in FIGS. 5A and 6A, the plurality of holes 17 are formed at the pitch P1 along the longitudinal direction of the fastener tape 10 on the element non-shaping region B of the woven and tape-shaped core material 14 by the laser machining device (step S1). As the holes 17 are formed using the heat by the laser machining device, as illustrated in FIG. 6B, the edge 17*a* of the hole 17 is molten. At that time, the plurality of holes 17 are formed so that the edge 17*a* is molten. The holes 17 may be punched by blowing the heated air from a nozzle, or may be punched by the heated needle member. Of course, a temperature in this instance is higher than a molten temperature of the warp yarn 12 and the weft yarn 13.

In step S2, the coating material 15 is formed to cover the front and back surfaces of the tape-shaped core material 14 formed with the plurality of holes 17 through the extrusion molding (step S2). In this instance, the elastomer material configuring the coating material 15 passes through the plurality of holes 17 of the tape-shaped core material 14, and thus the coating layers 15*a* and 15*b* of the front and back are integrally coupled to each other by the coupling portion 15*c*.

Next, the plurality of fixation holes 16 penetrating the tape-shaped core material 14 and the coating material 15 are formed at the pitch P2 in the element shaping region A along the longitudinal direction of the fastener tape 10 (step S3). After that, the fastener elements 21 are attached to the element shaping regions A of the fastener tapes 10 with the injection molding, the coupling portions 21*c* of the fastener elements 21 are formed in the fixation holes 16, and the fastener elements 21 are integrally formed on the front and back surfaces of the fastener tapes 10 (step S4).

In addition, after the fastener tapes 10 are cut to have a predetermined length (step S5), the top end stop, the bottom end stop 4, and the slider 3 are attached to the fastener tapes 10 (step S6), thereby completing the manufacture of the slide fastener 1. In this instance, the cut may be performed after the top end stop, the bottom end stop 4, and the slider 3 are attached.

Figure 7:
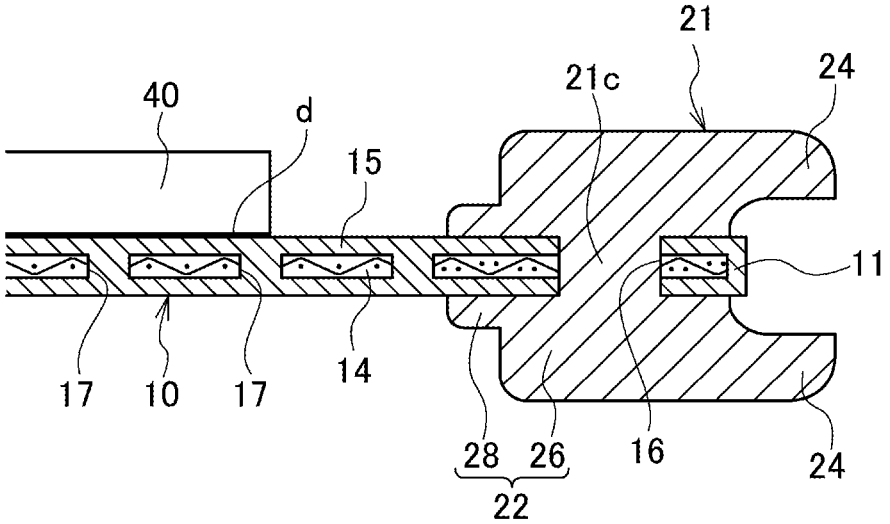
FIG. 7 is a cross-sectional view illustrating the state in which an attached body is attached to the fastener stringer.

The slide fastener 1 manufactured by the above process is adhered to a target body 40, such as clothes, by high frequency, as illustrated in FIG. 7 (d indicates the adhered portion in the drawing). Otherwise, in the case where water-tightness is not necessary, the slide fastener may be sewed to the target body 40. After sewing, the tape made of resin can be attached to the portion to bring out the water-tightness. In this embodiment, since the plurality of holes 17 are formed in the region to which the target body 40 is adhered, peeling strength of such region is increased. Therefore, even when tension is applied to the target body 40, it is possible to prevent the coating material 15 from peeling off from the tape-shaped core material 14.

As described above, according to the slide fastener 1 of this embodiment, the tape-shaped core material 14 is formed with the plurality of holes 17 penetrating in the front-back direction thereof, the holes disposed at the positions outer than the base portion 22 of the fastener elements 21 in the width direction and arranged along the longitudinal direction of the fastener tapes 10. Accordingly, the fastener tapes 10 each of which is formed by coating the tape-shaped core material 14 with the coating material 15 can firmly couple the tape-shaped core material 14 and the coating material 15. In the case where a strong lateral pulling force is applied to the fastener tape 10 or the fastener tape 10 is repeatedly bent, it is possible to prevent the coating material 15 from peeling off from the tape-shaped core material 14. Furthermore, since the edge 17*a* of each of the holes 17 is molten, the strength of the woven tape-shaped core material 14 can be secured even though the plurality of holes 17 are provided. The holes 17 of the tape-shaped core material 14 are covered by the coating material 15.

In addition, it is preferable that the total area of the plurality of holes 17 formed in the tape-shaped core material 14 is smaller than the area of the portion of a portion of the tape-shaped core material 14, the portion outer than the fastener elements 21 in the width direction and other than the holes 17. Accordingly, the tape-shaped core material 14 and the coating material 15 are firmly engaged with each other by the plurality of holes 17, and thus the tensile strength of the tape-shaped core material 14 can be secured.

It is preferable that when the distance between the end portion 28*c* of the base portion 22 of the respective fastener elements 21 and the other-side edge 19 of the fastener tape 10, opposite to the one-side edge 11 in the width direction is set to L, at least one of the plurality of holes 17 is positioned in the region of L/4 from the end portion 28*c* of the base portion 22. Accordingly, even though the slider 3 comes in contact with the region of L/4 when the slider 3 is slid, it is possible to further reliably prevent the coating material 15 from peeling off from the tape-shaped core material 14. Accordingly, it is possible to prevent the floated coating material 15 from being broken as the coating material 15 is worn by the contact with the slider 3.

In addition, the predetermined pitch P1 between the holes 17 adjacent to each other in the longitudinal direction of the fastener tapes 10 is set to be equal to or less than the pitch P2 between the adjacent fastener elements 21 which are arranged at the same interval. Accordingly, it is possible to prevent the coating material 15 between the adjacent holes 17 in the longitudinal direction of the fastener tape 10 from peeling off from the tape-shaped core material 14. Also, even if the coating material 15 is floated, it is possible to suppress the floating of the coating material 15, thereby preventing damage of the coating material 15.

Furthermore, according to the method for manufacturing the slide fastener 1 of this embodiment, the fastener stringer 2 is manufactured by opening the plurality of holes 17 which penetrate the front and back of the woven and tape-shaped core material 14, along the longitudinal direction of the tape-shaped core material 14 with use of the heat to melt an edge 17*a* of each of the holes, forming the coating material 15 on the tape-shaped core material 14, forming the plurality of fixation holes 16 which penetrate the tape-shaped core material 14 and the coating material 15, at the one-side edge 11 of the fastener tape 10, and attaching the fastener elements 21 to the one-side edge 11 with the injection molding. Accordingly, while the strength of the woven tape-shaped core material 14 is secured, it is possible to manufacture the slide fastener 1 in which the tape-shaped core material 14 and the coating material 15 of the fastener tape 10 are firmly engaged with each other. Also, since the coating material 15 is fixed to the tape-shaped core material 14 without using an adhesive, the flexible fastener tape 10 can be formed.

Since the respective holes 17 are opened by heat from the laser machining device, the plurality of holes 17 can be opened with high precision.

Although the present invention is not limited to the above-described embodiment, and can be properly modified or revised.

In the above-described embodiment, when the fastener elements 21 of the left and right fastener stringers 2 are engaged with each other, the coating materials 15 of the left and right fastener tapes 10 abut against each other, thereby providing the water-tightness and the gas-tightness. However, if the coating material 15 is provided on both the front and back surfaces of the tape-shaped core material 14, it is not limited to that the coating materials 15 abut against each other. In this instance, the pitch P1 and the pitch P2 may be equal, or the pitch P1 may be an interval larger than the pitch P2.

Figure 8:
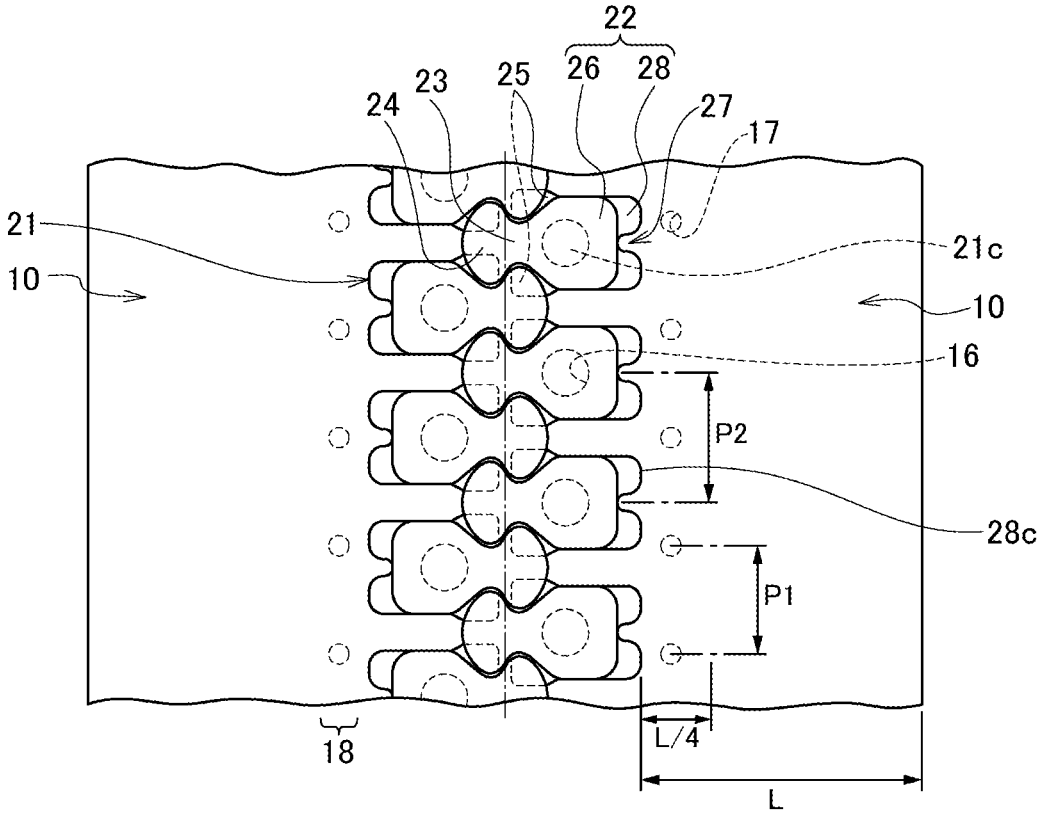
FIG. 8 is a plan view illustrating a coupling portion of a slide fastener according to a first modification of the present invention.
Figure 9:
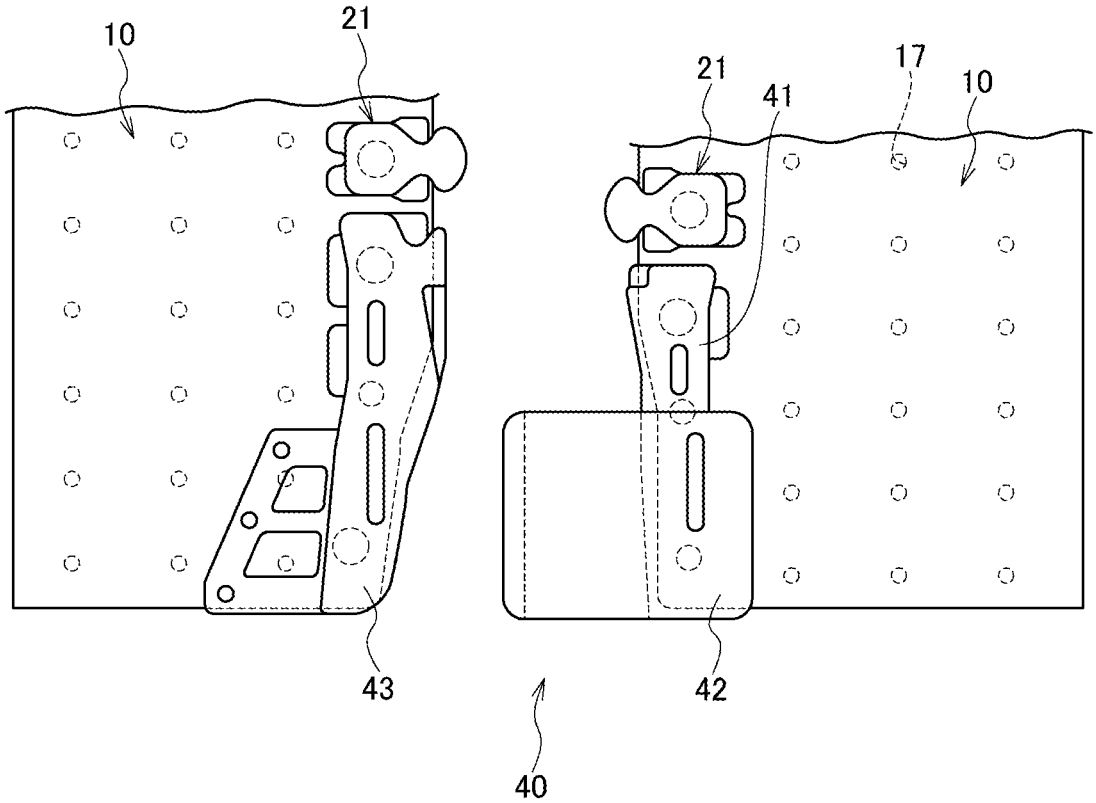
FIG. 9 is a plan view illustrating the state in which a separable end stop is attached to a fastener tape according to a second modification of the present invention.

The plurality of holes 17 of the present invention may be positioned in only the region of L/4 from the end portion 28*c* of the base portion 22. For example, like the first modification illustrated in FIG. 8, the linear hole rows 18 formed with the plurality of holes 17 may be positioned only near the base portion 22, that is, only the region of L/4 from the end portion 28*c* of the base portion 22.

Also, although the bottom end stop 4 is attached to the lower portion of the fastener element row 20 in the above embodiment, the present invention can be applied to the case where a separable end stop 40 for completely separating the pair of left and right fastener tapes 10 is attached. In this instance, the separable end stop 40 includes a box pin 41 and a box body 42 which are attached to the one-side edge 11 of the fastener tape 10 in a continuous form from the lower end of the one-side fastener element row 20, and an insert pin 43 which is attached to the one-side edge 11 of the fastener tape 10 in a continuous form from the lower end of the other-side fastener element row 20.

DESCRIPTION OF REFERENCE NUMERALS

1: Slide Fastener
2: Fastener Stringer
3: Slider
10: Fastener Tape
11: One-Side Edge
14: Tape-Shaped Core Material
15: Coating Material
16: Fixation Hole
17: Hole
17*a*: Edge
19: The Other-Side Edge
20: Fastener Element Row
21: Fastener Element
22: Base Portion
23: Head Portion
24: Engagement Head Portion
25: Shoulder Portion
28*c*: End Portion

The invention claimed is:

1. A slide fastener comprising:

a pair of fastener stringers including a pair of fastener tapes and fastener element rows which are respectively attached to opposing edges of the pair of fastener tapes, each of the fastener element rows including a plurality of fastener elements, each of the pair of fastener tapes including a woven and tape-shaped core material and a coating material which coats front and back surfaces of the core material and both outside edges of the core material; and a slider slidably attached to the fastener element rows to engage and disengage the fastener elements, wherein the tape-shaped core material is formed with a plurality of through holes, the through holes disposed at positions between the fastener elements and the outside edges in a width direction of the fastener tapes and arranged along a longitudinal direction of the fastener tapes, and wherein the coating material fills the plurality of through holes.

2. The slide fastener according to claim 1, wherein each of the fastener tapes includes an element shaping region where the fastener elements are attached and an element non-shaping region which is positioned between the fastener elements and the outside edges in the width direction of the fastener tapes, and wherein a total area of the plurality of through holes formed in the tape-shaped core material is smaller than an area of the non-shaping region of the tape-shaped core material, other than the through holes.

3. The slide fastener according to claim 1, wherein when a distance between an end portion of each of the fastener elements and the outer edge of the fastener tapes in the width direction is set to L, at least one of the plurality of through holes is positioned in a region of L/4 from the end portion.

4. A method for manufacturing the slide fastener according to claim 1, wherein the fastener stringer is manufactured by:

opening a plurality of through holes which penetrate front and back of a woven and tape-shaped core material, along a longitudinal direction of the tape-shaped core material with use of heat to melt an edge of each of the through holes;

forming a coating material on the tape-shaped core material so that the coating material coats front and back surfaces of the tape-shaped core material and both edges of the tape-shaped core material;

forming a plurality of fixation through holes which penetrate the tape-shaped core material and the coating material; and attaching fastener elements to the tape-shaped core material and the coating material using the fixation through holes and injection molding.

5. The method for manufacturing the slide fastener according to claim 4, wherein the plurality of through holes are opened by heat from a laser machining device.

6. The slide fastener according to claim 1, wherein the pair of fastener stringers are configured to have water-tightness and gas-tightness.

* * * * *